United States Patent [19]

Schonpflug

[11] 4,006,001

[45] Feb. 1, 1977

[54] PRODUCTION OF INTERMEDIATE PURITY OXYGEN BY PLURAL DISTILLATION

[75] Inventor: Eugen Schonpflug, Munich, Germany

[73] Assignee: Linde Aktiengesellschaft, Wiesbaden, Germany

[22] Filed: Jan. 20, 1975

[21] Appl. No.: 542,270

[30] Foreign Application Priority Data

Jan. 18, 1974 Germany ..... 2402246

[52] U.S. Cl. ..... 62/29; 62/31; 62/41

[51] Int. Cl.[2] ..... F29J 3/02

[58] Field of Search ..... 62/29, 30, 41, 23, 24, 62/25, 26, 27, 28, 38, 42, 43, 31

[56] References Cited

UNITED STATES PATENTS

| | | | |
|---|---|---|---|
| 2,002,940 | 5/1935 | Frankl | 62/29 |
| 2,728,205 | 12/1955 | Becker et al. | 62/24 |
| 2,833,127 | 5/1958 | Vesque et al. | 62/29 |
| 3,210,951 | 10/1965 | Gaumer, Jr. | 62/29 |
| 3,298,184 | 1/1967 | Smith | 62/29 |

FOREIGN PATENTS OR APPLICATIONS 827,364 7/1949 Germany

*Primary Examiner*—Frank W. Lutter
*Assistant Examiner*—Frank Sever
*Attorney, Agent, or Firm*—Millen & White

[57] ABSTRACT

In a process for the production of oxygen of intermediate purity by a two-stage low-temperature rectification of air in two distinct and spaced apart rectifying columns, wherein an oxygen-rich liquid fraction is withdrawn from the sump of a low-pressure column, conveyed by means of a pump to a condenser located at the head of a high-pressure column, and vaporized at that location in indirect heat exchange with condensing nitrogen the improvement wherein said liquid fraction evaporating in the condenser in the head of the high-pressure column is withdrawn in its entirety as product oxygen, whereby the pressure in the high-pressure column is lowered as compared to a process where some of the product oxygen is recycled to the low pressure column.

3 Claims, 1 Drawing Figure

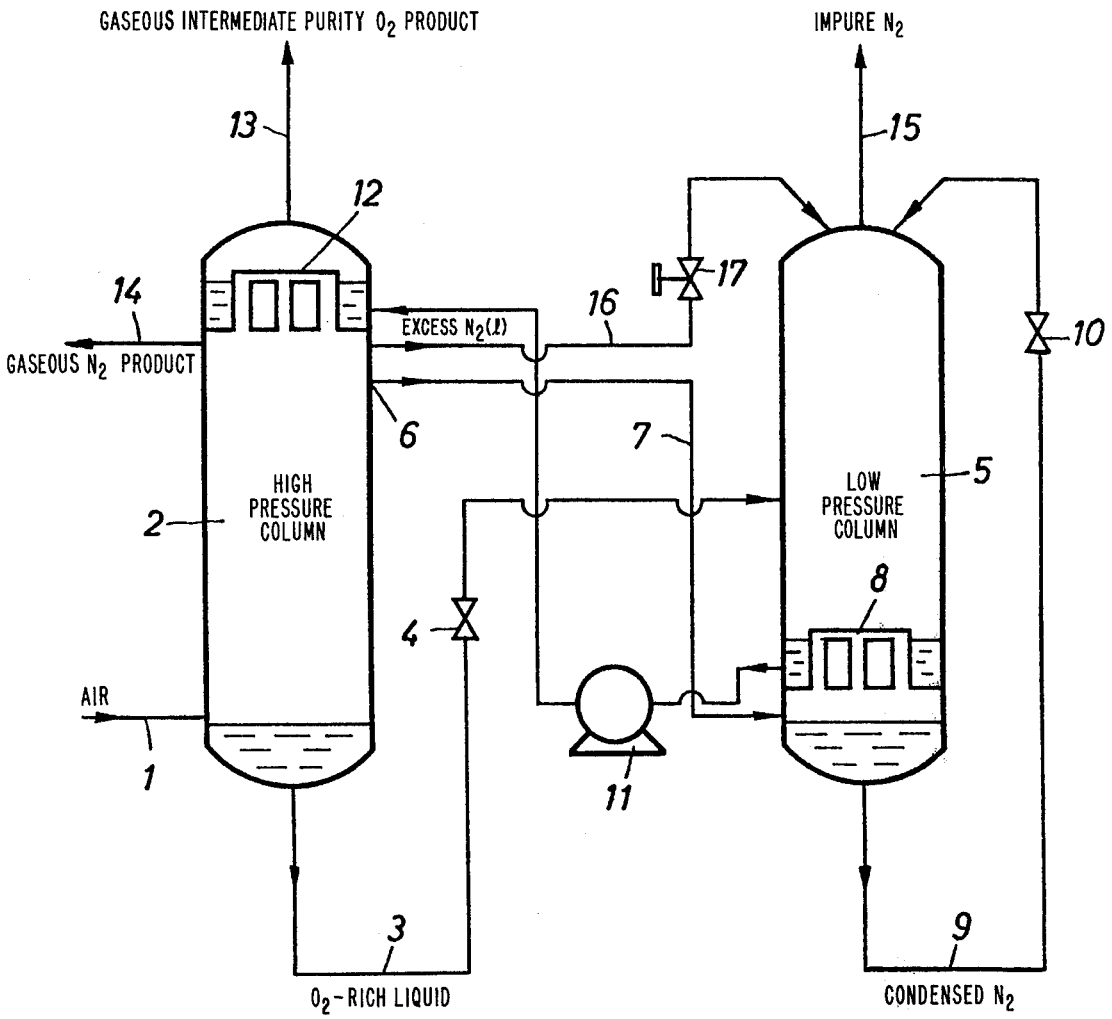
GASEOUS INTERMEDIATE PURITY $O_2$ PRODUCT
IMPURE $N_2$
13
15
12
14
17
16
10
EXCESS $N_2$(L)
GASEOUS $N_2$ PRODUCT
6
7
5
HIGH PRESSURE COLUMN
LOW PRESSURE COLUMN
2
8
4
AIR
1
11
3
9
$O_2$-RICH LIQUID
CONDENSED $N_2$

PRODUCTION OF INTERMEDIATE PURITY OXYGEN BY PLURAL DISTILLATION

BACKGROUND OF THE INVENTION

This invention relates to a cryogenic process for obtaining oxygen of intermediate purity by a two-stage low-temperature rectification of air in two independent and distinct rectifying columns spaced apart from each other. By oxygen of intermediate purity is meant on a volume % basis a fractionated air stream containing 35 to 95%, especially about 55 to 90% oxygen.

A generally known process comprises withdrawing an oxygen-rich fraction in the liquid phase from the sump of a low-pressure column, pumping said fraction to the head of a high-pressure column, and vaporizing said fraction at that location in heat exchange with condensing nitrogen. Such a process is shown in German Pat. No. 827,364 wherein precooled air compressed to 5 bars is subjected to the first rectification stage in the high-pressure column. The oxygen-rich liquid fraction obtained in the sump of the high-pressure column is expanded via an expansion valve into the low-pressure column and subjected therein to a further rectification. The nitrogen required for this purpose is withdrawn in the gaseous phase from the head of the high-pressure column, liquefied in the condenser arranged in the sump of the low-pressure column, and fed to the head of the low-pressure column by way of an expansion valve. The condensation of the nitrogen takes place under heat exchange with the strongly enriched liquid oxygen fraction accumulating on the low-pressure side of the condenser; this latter fraction is partially revaporized during this step, but in part is also conveyed by means of a pump into the head of the high-pressure column, where it is vaporized, in turn, in a condenser under heat exchange with condensing nitrogen. This strongly enriched oxygen vapor produced in the head condenser of the high-pressure column is withdrawn, in part, as product oxygen but, in part, is recycled into the evaporation space above the condenser of the low-pressure column, to continue to take part in the rectification process.

If the aforementioned conventional process is utilized in the production of oxygen having merely an intermediate purity, there is the disadvantage that the process air must be compressed to a relatively high pressure, determined by the oxygen concentration in the product and the pressure in the sump of the low-pressure column. Consequently, the amount of power required for this purpose is relatively high as compared to the required degree of purity of the product oxygen.

SUMMARY OF THE INVENTION

An object of this invention is to provide a modification of the aforesaid conventional process so that its use is economically attractive when producing oxygen of only intermediate purity.

Upon further study of the specification and appended claims, further objects and advantages of this invention will become apparent to those skilled in the art.

These objects are attained by withdrawing the fraction evaporating in the head of the high-pressure column entirely as product oxygen, and reversing the process to embody this fundamental change. Thus, in contrast to the conventional process, no vapor fraction is recycled into the low-pressure column. The communication between the vapor spaces above the condensers need no longer be maintained as it is now possible to select the pressure of the withdrawn product oxygen independently of the pressure ambient in the low-pressure column. The temperature of the liquid fraction boiling in the head condenser of the high-pressure column is dependent on the pressure and on the composition, i.e., the greater the reduction in the pressure of the product oxygen withdrawn by pumping, and the lower its oxygen content, the steeper the decrease in the boiling temperature of the liquid phase.

As a consequence of the present invention, condensation takes place on the nitrogen side of the head condenser of the high-pressure column at a lower temperature and thus under a lower pressure. The temperature of the liquid obtained in the sump of the low-pressure column is lower, because its oxygen concentration need only correspond to that of the gaseous product oxygen, rather than to the higher oxygen concentration of the liquid fraction boiling below the gaseous product oxygen. Thereby, the pressure required for condensation on the nitrogen side of the low-pressure condenser is also lowered.

As a result, the total pressure of the process air fed into the high-pressure column can likewise be lowered. The energy required for compressing the process air thus depends, in the final analysis, on the extent to which the separation of the air is continued into its components oxygen and nitrogen, and under which pressure the product gas is to be withdrawn. Therefore, the present process is more adaptable to the case of obtaining oxygen of intermediate purity and is more economical than the procedure described in German Pat. No. 827,364.

According to a further embodiment of the invention, excess liquid nitrogen from the upper section of the high-pressure column can be fed via a special conduit to the head of the low-pressure column.

For conducting the process of the invention, suitable apparatus comprises: one condenser provided in each of (a) the head of the high-pressure column, and (b) the bottom of the low-pressure column (in these condensers, fractions enriched with differing concentrations of $O_2$ are vaporized in heat exchange with condensing nitrogen). The only communication between the oxygen sides of the condensers is a conduit provided with a pump for conveying the liquid fraction from the sump of the low-pressure column to the condenser in the head of the high-pressure column.

DESCRIPTION OF PREFERRED EMBODIMENTS

The attached FIGURE is a schematic illustration of the preferred embodiment of the present invention.

Referring specifically to the drawing, the compressed and precooled air is introduced via conduit 1 into a high-pressure column 2. During the course of the rectification, an oxygen-rich sump liquid is formed at the bottom of this high-pressure column; this sump liquid is conducted via conduit 3 and expansion valve 4 into a low-pressure column 5 to be subjected to a further rectification therein. The nitrogen gas required for this purpose is withdrawn in the gaseous phase from the high-pressure column at 6 and introduced via conduit 7 into a condenser 8 arranged in the bottom of the low-pressure column, where the nitrogen is condensed in heat exchange with evaporating, enriched low-pressure oxygen. Resultant condensed nitrogen is thereafter expanded through conduit 9 and throttle valve 10 into the low-pressure portion of column 5. The liquid, strongly enriched with oxygen, which collects on the low-pressure side of the condenser 8 is partially vaporized in in heat exchange with nitrogen to be condensed and, in part, conveyed by means of a pump 11 into a condenser 12 located in the head of the high-pressure column. The liquid is evaporated therein in heat exchange with condensing nitrogen and is discharged in its entirety as product oxygen by way of conduit 13. Gaseous product nitrogen can be discharged via conduit 14, and impure nitrogen can be withdrawn as residual gas from conduit 15; the impure nitrogen can be employed, for example, for the purging of regenerators. Excess liquid nitrogen can be introduced via conduit 16 and control valve 17 from the high-pressure column into the head of the low-pressure column. Thus it is possible to control the quantity of reflux nitrogen in columns 2 and 5 within certain limits to achieve optional distribution of the nitrogen liquefied in condenser 12.

The following description will list several values which are to convey an impression of the extent to which the pressure $p_1$ of the compressed process air can be lowered in dependence on the concentration of the product oxygen.

The pressure under which the oxygen is withdrawn from column 2 is a constant 1.2 bars. The symbol $p_2$ is to denote the pressure on the nitrogen side of the condenser 12, which differs somewhat from the pressure of the introduced air due to the column resistance. (A bar is an absolute international unit of pressure equivalent to 1.013 kg/cm$^2$ or 0.987 atm.)

| Concentration of Product Oxygen (%) | 80 | 70 | 59.3 |
|---|---|---|---|
| $p_1$ (bars) | 4.5 | 4.15 | 3.8 |
| $p_2$ (bars) | 4.2 | 3.85 | 3.5 |

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A low-temperature separation process for the production from air of oxygen of intermediate purity containing about 35 to 95% by volume oxygen, comprising:

a. subjecting air to low temperature rectification in a first distillation column operating under superatmospheric pressure to obtain a bottoms fraction enriched in oxygen and first overhead vapor enriched in nitrogen;

b. passing said bottoms fraction to a second distillation column operating at a pressure lower than said first column, said second and first columns being spaced apart and distinct from one another, and further distilling said bottoms fraction to obtain a bottoms liquid product of intermediate purity oxygen and a second overhead fraction enriched in nitrogen;

c. passing a portion of said first overhead fraction enriched with nitrogen from said first column into the bottom of said second column in indirect heat exchange relationship with said bottom liquid product of intermediate purity oxygen to vaporize a portion of said intermediate purity oxygen to be used as vapor boil-up in said second column and to condense said first overhead fraction enriched in nitrogen;

d. pumping a further portion of said bottoms liquid product of intermediate purity oxygen to a condenser located at the head of the first distillation column to completely vaporize said further portion and to condense a further portion of said first overhead fraction enriched in nitrogen; and e. withdrawing the entire resultant vaporized further portion of intermediate purity oxygen from said low temperature separation process, none of said vaporized further portion being recycled to the second column.

2. A process according to claim 1, further comprising passing a fraction of resultant condensed further portion of said first overhead fraction enriched in nitrogen from step (d) to the head of the second column, and passing resultant condensed first overhead fraction from step (c) also to the head of the second column, both of said condensed fractions being employed as reflux liquid in said second column.

3. A process according to claim 2, said oxygen of intermediate purity containing about 55 to 90% by volume of oxygen.

* * * * *